US008112974B1

(12) United States Patent
Angelos

(10) Patent No.: US 8,112,974 B1
(45) Date of Patent: Feb. 14, 2012

(54) MICROWAVEABLE FOOD PACKAGE

(75) Inventor: Theros Bill Angelos, Reno, NV (US)

(73) Assignee: Sierra Packaging and Converting, LLC, Sparks, NV (US)

( * ) Notice: Subject to any disclaimer, the term of this patent is extended or adjusted under 35 U.S.C. 154(b) by 0 days.

(21) Appl. No.: 12/759,075

(22) Filed: Apr. 13, 2010

Related U.S. Application Data

(62) Division of application No. 11/615,476, filed on Dec. 22, 2006, now Pat. No. 7,723,656.

(51) Int. Cl.
*B65B 9/06* (2006.01)

(52) U.S. Cl. ..... 53/451; 53/411; 53/477; 493/186; 493/187; 219/725

(58) Field of Classification Search ..... 53/411, 53/451, 452, 477, 266.1, 284.7, 375.9; 493/186, 493/187, 189, 267, 227, 228, 240, 291, 320, 493/467; 219/726–735; 426/106, 107, 113, 426/124, 241, 243, 392, 410
See application file for complete search history.

(56) References Cited

U.S. PATENT DOCUMENTS 4,077,588 A 3/1978 Hurst
4,657,610 A * 4/1987 Komatsu et al. ..... 156/87
5,171,950 A * 12/1992 Brauner et al. ..... 219/727
5,220,140 A * 6/1993 Ball et al. ..... 219/759
5,492,705 A * 2/1996 Porchia et al. ..... 426/106
5,518,799 A * 5/1996 Finestone et al. ..... 428/137
5,698,249 A * 12/1997 Hayashi et al. ..... 426/106
5,786,064 A * 7/1998 Finestone et al. ..... 428/137
6,610,391 B2 * 8/2003 Molee ..... 428/212
6,631,605 B1 * 10/2003 Quintin et al. ..... 53/451
6,635,290 B1 * 10/2003 Boyer et al. ..... 426/106
6,884,978 B2 * 4/2005 Monforton et al. ..... 219/727
7,038,182 B2 * 5/2006 Young et al. ..... 219/730
7,056,569 B2 * 6/2006 Price et al. ..... 428/137
7,141,034 B2 11/2006 Eppstein et al.
7,387,205 B1 * 6/2008 Wilson ..... 206/524.4
7,723,656 B1 5/2010 Angelos
2002/0110625 A1 * 8/2002 Garwood ..... 426/392

* cited by examiner

*Primary Examiner* — Paul Durand
(74) *Attorney, Agent, or Firm* — Lewis and Roca LLP

(57) ABSTRACT

A microwavable food package is disclosed, comprising a packaging sheet including first and second column of apertures, the apertures between 100 microns and 800 microns in diameter; and a central seal, the central seal joining a first edge of the packaging sheet to a second edge of the packaging sheet, the central seal running longitudinally along the length of the food package, wherein the first column of apertures is on one side of the central seal and the second column of apertures is on the other side of the central seal.

17 Claims, 2 Drawing Sheets

MICROWAVEABLE FOOD PACKAGE

CROSS-REFERENCE TO RELATED APPLICATIONS

This application is a divisional of co-pending U.S. patent application Ser. No. 11/615,476, filed Dec. 22, 2006, the entirety of which is incorporated by reference herein.

FIELD

The present invention relates broadly to food packaging. Specifically, the present invention relates to microwaveable food packaging that vents while cooking in a microwave oven.

BACKGROUND

Microwave ovens are present in nearly every kitchen. Supermarkets now sell a vast assortment of microwaveable food products. However, in many microwaveable products, the heat generated inside the food packaging needs to be handled carefully to prevent injury and improper cooking of the food contained within the microwaveable package.

Prior approaches to solving this problem are insufficient. Some packaging requires the user to cut open a portion of a plastic pouch. Usually this is only at one end of the package, and done simply to prevent a pressure buildup within the plastic pouch. This does not allow proper airflow in many instances, and in some cases can allow food to spill out of the package during cooking or handling. In another approach, a clip is attached to the pouch after it is opened to close the package yet allow the package to vent, but some users will fail to attach the clip properly, and leakage may still occur.

Thus, there still remains a heartfelt need to for a microwaveable food package that incorporates improved venting.

SUMMARY

The present invention provides a microwaveable food package that incorporates very small perforations made by a laser on portions of a plastic pouch. In an embodiment, these perforations are on opposite sides of one panel of a plastic pouch in a strip pattern. The perforations are quite small and in some cases unnoticeable to the human eye, and do not require the user to slit open the pouch or open any portion of the pouch. In the case of frozen food, the perforations can be oriented on one side of the pouch, so that the pouch can be laid on a plate or other surface inside the microwave oven with the perforations facing up, so that no food leaks out of the pouch as the pouch cooks. One main benefit realized from the present invention is a more uniform venting of the food while it cooks, so that the chance of scalding the user or improperly cooking the food is greatly reduced.

DETAILED DESCRIPTION

Figure 1:
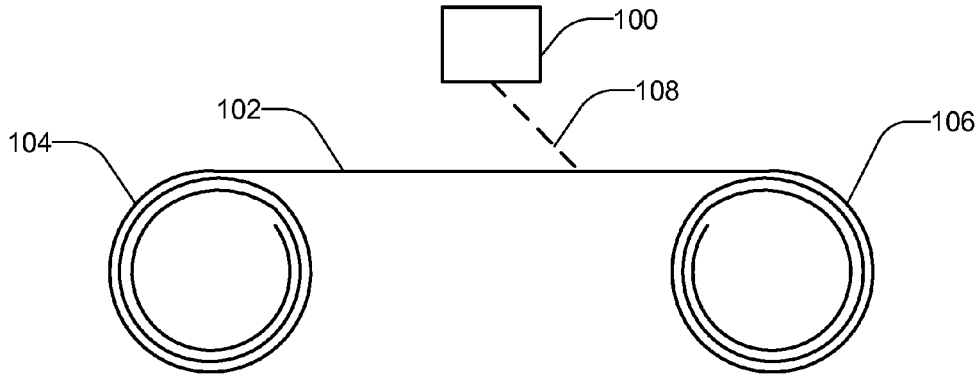
FIG. 1 illustrates the formation of apertures in food packaging by a laser.

Directing attention to FIG. 1, laser 100 is positioned above packaging sheet 102, which is fed from supply roller 104 to collection roller 106. Laser beam 108 is directed to packaging sheet 102, and perforates packaging sheet 102 as it passes beneath laser 100. In the preferred embodiment, laser 100 is comprised of a Laser Processing Module 100, available from LasX Industries, Inc., of White Bear Lake, Minn. Laser 100 can be configured to form apertures in a wide variety of patterns on packaging sheet 102, for example to avoid labeling or packaging graphics, or to intersperse apertures different areas of packaging sheet 102 so they are less noticeable to the human eye, or to meet oxygen flow requirements of the food contained with the food package. In an embodiment, apertures can be formed in columns of apertures running the length of packaging sheet 102 to form a vent. In an embodiment, columns can be spaced two inches apart, or on opposite sides of a seal (such as a lap seal or a fin seal) that often is formed in the center of one panel of a food package. Apertures are formed with a diameter ranging from approximately 100 microns to approximately 800 microns, preferably at 400 microns in diameter. The size of the hole may depend on several different factors, such as the size of the food package, the required oxygen transfer, or aesthetics.

Packaging sheet 102 may be polyester, oriented polypropylyn, cast, polypropylyn, nylon, mylar, polyethylene, or other suitable material. Packaging sheet may also comprise several layers of these materials depending on packaging needs, as known to those skilled in the art.

Figure 2:
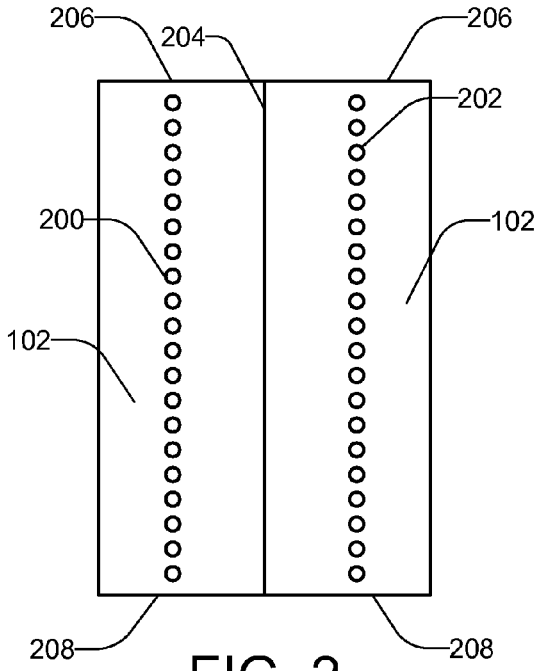
FIG. 2 illustrates an embodiment of aperture configuration in the packaging sheet.

Directing attention to FIG. 2, a segment of packaging sheet 102 is shown. Packaging sheet 102 contains aperture column 200 and aperture column 202, which are oriented on opposite sides of seal 204. Seal 204 is generally formed by affixing two edges of packaging sheet 102, in either a lap seal or fin seal as described above. By placing columns 200, 202 at opposite sides of packaging sheet 102 and sealing ends 206, 208, a sealed food pouch can be formed around a food product to be microwaved, thus providing improved oxygen transfer to the food product as well as a safer food package that poses less threat of scalding a user upon removal from the microwave oven.

Figure 3:
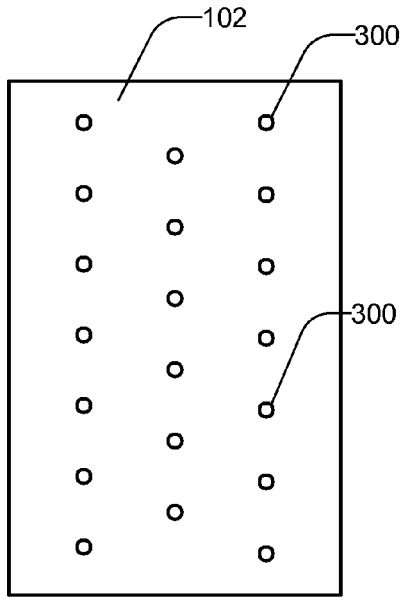
FIG. 3 illustrates an alternative embodiment of aperture configuration in the packaging sheet.

Directing attention to FIG. 3, apertures 300 can be interspersed throughout the packaging sheet 102, and have the same diameter as described above.

Figure 4:
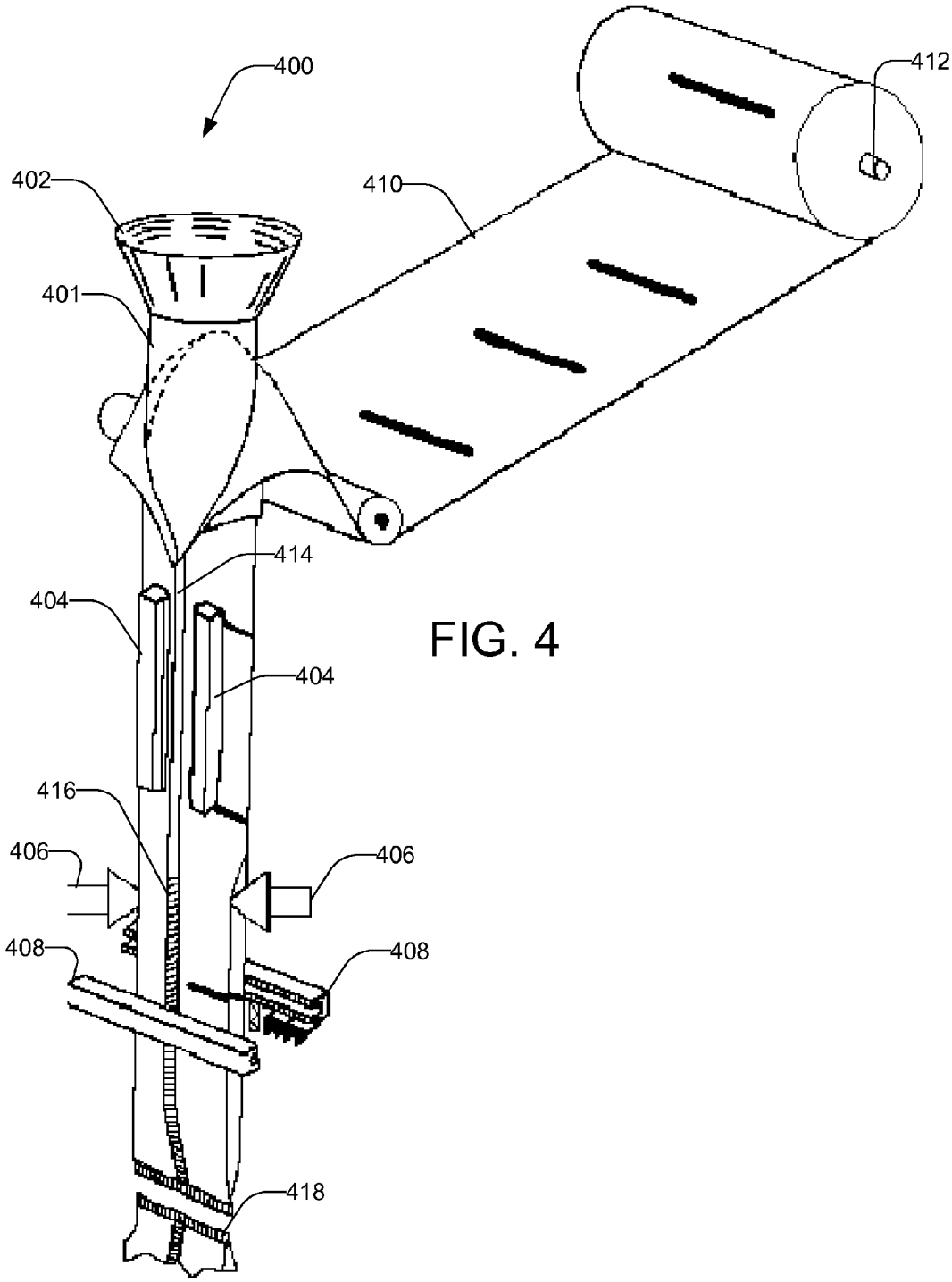
FIG. 4 illustrates Vertical Form-Fill-Seal (VFFS) equipment creating a food package, in accordance with the prior art.

FIG. 4 illustrates Vertical Form-Fill-Seal (VFFS) equipment creating a food package, in accordance with the prior art. VFFS equipment 400 are currently utilized to create and fill packages containing a number of different food items, including fresh and frozen vegetables, fresh fruits, potato chips, popcorn, etc. The VFFS equipment 400 comprises a fill funnel 402 for accepting the food item to be packaged attached at the top of a fill tube 401. The quantity of food to be packaged into a single package will typically be metered before being placed in the fill funnel 402. Meanwhile, a packaging sheet 410 is fed on a roller 412 to the VFFS equipment 400. It is wrapped completely around the fill tube 401 located below the fill funnel 402. Two vertical seams 414 are joined together utilizing, for example, a vertical crimping or sealing unit 404 that applies heat, pressure, or other means to accomplish the joining The result is a long hollow tube with a side seam 416 wrapped around the fill tube 401. The packaging may then be gusseted by a gusting mechanism 406. Next, the long hollow tube is sealed at the bottom with a horizontal sealing unit 408, utilizing, for example, heat and/or pressure to seal the bottom of the long hollow tube. At this point, the food items or other contents are metered and inserted into the fill funnel 402, travel down the fill tube 401, into the hollow tube that is sealed on the bottom. Meanwhile, the hollow tube drops down a prescribed distance, and the tube is again sealed with the horizontal sealing unit 408. The packaging is then complete, except that the packaged food or other items is still attached to the bottom of the hollow tube of packaging material. A cutting unit (not shown), for example utilizing a knife blade, then cuts the packaged food or other items from the hollow tube of packaging material, and the packaging is complete. Note that in this illustration, the vertical sealing unit actually provides two seals, one above the other, at a time, and the cutting unit cuts between the two seals, resulting in an average of one seal per package of food or other items produced, since each the package shares the sealing with the package above and the package below. This is exemplary, and other methods of packaging food products are also within the scope of the present invention.

While a microwaveable food package has been described and illustrated in detail, it is to be understood that many changes and modifications can be made to various embodiments of the present invention without departing from the spirit thereof.

What is claimed is:

1. A method of constructing a microwavable food package, the method comprising:

forming a plurality of apertures between 200 microns and 600 microns in diameter in two parallel columns on a packaging sheet using a laser;

joining one edge of the packaging sheet to an opposite edge of the packaging sheet around a fixed quantity of a food product to form a joined packaging sheet wherein the two parallel columns of apertures are formed to be parallel to the one edge joined to the opposite edge of the packaging sheet;

sealing a first end of the joined packaging sheet; and sealing a second end of the joined packaging sheet.

2. The method of claim 1, wherein the central seal comprises a lap seal.

3. The method of claim 1, wherein the central seal comprises a fin seal.

4. The method of claim 1, wherein the packaging sheet comprises oriented polypropylyn.

5. The method of claim 1, wherein the packaging sheet comprises cast polypropylyn.

6. The method of claim 1, wherein the packaging sheet comprises nylon.

7. The method of claim 1, wherein the packaging sheet comprises mylar.

8. The method of claim 1, wherein the packaging sheet comprises polyethylene.

9. The method of claim 1, wherein the packaging sheet comprises a plurality of layers.

10. The method of claim 9 which further comprises:

creating the packaging sheet by laminating a first layer of packaging material to a second layer of packaging material, the first layer and the second layer each having an internal side and an external side, the internal sides of the two layers being laminated together.

11. The method of claim 10 wherein the laminating utilizes heat.

12. The method of claim 10 wherein the laminating utilizes pressure.

13. The method of claim 1 wherein:

the sealing of the first end of a second food package operates as the sealing of the second end of a first food package.

14. The method of claim 1 wherein the food product comprises frozen vegetables.

15. A method of constructing a microwavable food package, the method comprising:

forming a plurality of apertures between 200 microns and 600 microns in diameter in two parallel columns on a packaging sheet using a laser, wherein apertures in a first of the two columns are separated by a distance of two inches;

joining one edge of the packaging sheet to an opposite edge of the packaging sheet around a fixed quantity of a food product to form a joined packaging sheet;

sealing a first end of the joined packaging sheet; and sealing a second end of the joined packaging sheet.

16. The method of claim 15, wherein apertures in a second of the two columns are separated by a distance of two inches.

17. A method of constructing a microwavable food package, the method comprising:

creating a packaging sheet by laminating a first layer of packaging material to a second layer of packaging material, the first layer and the second layer each having an internal side and an external side, the internal sides of the two layers being laminated together;

printing advertising material on an internal side of the first layer before the first layer is laminated to the second layer;

forming a plurality of apertures between 200 microns and 600 microns in diameter in two parallel columns on the packaging sheet using a laser;

joining one edge of the packaging sheet to an opposite edge of the packaging sheet around a fixed quantity of a food product to form a joined packaging sheet;

sealing a first end of the joined packaging sheet; and sealing a second end of the joined packaging sheet.

* * * * *